US009683347B2

(12) United States Patent
Lucia et al.

(10) Patent No.: US 9,683,347 B2
(45) Date of Patent: Jun. 20, 2017

(54) SYSTEMS AND METHODS TO REINFORCE EXCAVATION WALLS

(71) Applicant: Post Tensioning Solutions LLC, Kent, WA (US)

(72) Inventors: Joseph Marino Lucia, Seattle, WA (US); Rick Allen Thompson, Kent, WA (US)

(73) Assignee: Post Tensioning Solutions LLC, Kent, WA (US)

( * ) Notice: Subject to any disclaimer, the term of this patent is extended or adjusted under 35 U.S.C. 154(b) by 0 days.

(21) Appl. No.: 14/495,600

(22) Filed: Sep. 24, 2014

(65) Prior Publication Data

US 2015/0086278 A1 Mar. 26, 2015

Related U.S. Application Data

(60) Provisional application No. 61/882,228, filed on Sep. 25, 2013.

(51) Int. Cl.

| | |
|---|---|
| ***E02D 17/20*** | (2006.01) |
| ***E02D 5/18*** | (2006.01) |
| ***E02D 17/04*** | (2006.01) |

(52) U.S. Cl.

CPC ..... *E02D 17/207* (2013.01); *E02D 5/18* (2013.01); *E02D 17/04* (2013.01)

(58) Field of Classification Search

CPC ..... E02D 17/207; E02D 17/04; E02D 5/18
See application file for complete search history.

(56) References Cited

U.S. PATENT DOCUMENTS

| | | | | | |
|---|---|---|---|---|---|
| 3,999,392 | A * | 12/1976 | Fukushima | E02D 5/20 | 405/281 |
| 4,369,004 | A * | 1/1983 | Weatherby | E02D 29/02 | 405/262 |
| 4,561,804 | A * | 12/1985 | Weatherby | E02D 29/02 | 405/262 |
| 5,313,749 | A * | 5/1994 | Conner | E04C 3/10 | 52/223.12 |
| 6,332,301 | B1 * | 12/2001 | Goldzak | E04B 5/04 | 52/223.1 |
| 6,751,821 | B1 * | 6/2004 | Han | E01D 2/02 | 14/74.5 |
| 2011/0142550 | A1 | 6/2011 | Lee | | |

FOREIGN PATENT DOCUMENTS

| | | | |
|---|---|---|---|
| KR | 19990033055 | A * | 5/1999 |
| KR | 20090076688 | A * | 7/2009 |
| KR | 10-1274974 | B1 | 6/2013 |

OTHER PUBLICATIONS

International Search Report and Written Opinion mailed Dec. 4, 2014, for Corresponding International Application No. PCT/US2014/057284, 9 pages.

* cited by examiner

*Primary Examiner* — Tara M. Pinnock
(74) *Attorney, Agent, or Firm* — Seed IP Law Group LLP

(57) ABSTRACT

A soldier pile wall for shoring an excavation site includes a plurality of drilled shafts drilled along an edge of the excavation site, a plurality of soldier piles, each of the plurality of soldier piles being positioned within a respective drilled shaft, and a pre-stressing system coupled to at least some of the plurality of soldier piles. The pre-stressing system is configured to induce stresses to counteract working stresses of the soldier pile wall. Related methods are also provided.

16 Claims, 6 Drawing Sheets

SYSTEMS AND METHODS TO REINFORCE EXCAVATION WALLS

CROSS-REFERENCE TO RELATED APPLICATION

This application claims the benefit under 35 U.S.C. §119 (e) of U.S. Provisional Patent Application No. 61/882,228, filed Sep. 25, 2013, which is incorporated herein by reference in its entirety.

BACKGROUND

Technical Field

The present disclosure relates to reinforced walls for deep excavations, and more particularly to soldier pile walls.

Description of the Related Art

Construction of structures having large design loads, such as large buildings, sites where the soil is soft or lacks sufficient cohesion, where portions of the building are below ground level, such as parking garages, or where there are site constraints, such as property lines, that reduce the area of the excavation site, generally requires deep excavations. Such excavations may therefore have to be properly shored, which may be temporary or permanent shoring. Conventional methods of shoring may include constructing and installing soldier pile and lagging systems. The lagging of lagging systems may be less stiff than the soldier pile, which assists in retaining the soil between the soldier piles. The lagging may be made from timber, steel, or concrete, such as a secant pile, for example.

However, where the depth of excavations exceeds certain values; deflection tolerances are stringent due to proximate structures or utilities; or where the soil is soft or lacks cohesion, the soldier pile and lagging systems may need to be reinforced with tie-backs, struts, or internal bracing. Such reinforcement techniques, however, increase costs, are laborious, and are prone to interfere with proximate structures, such as where tieback anchors may cross property lines, roadways, and/or buried utilities, for example.

BRIEF SUMMARY

Embodiments described herein provide soldier pile walls, systems, and methods that are well-adapted to shore excavation sites using lighter and more slender soldier piles, improve the fatigue life, enhance the elastic range of the soldier pile material, and improve load-carrying capability of the soldier pile walls, among other advantages and benefits. According to one embodiment, a soldier pile for shoring an excavation site may be summarized as including a plurality of drilled shafts drilled along an edge of the excavation site; a plurality of soldier piles, with each of the plurality of soldier piles being positioned within a respective drilled shaft; and a pre-stressing system coupled to at least some of the plurality of soldier piles. The pre-stressing system may be configured to induce stresses to counteract working stresses of the soldier pile wall.

According to another embodiment, a system for shoring an excavation site having a plurality of adjacent holes drilled along an edge of the excavation site where a soldier pile wall is to be erected may be summarized as including a plurality of modular soldier piles, each of the plurality of modular soldier piles to be positioned within a respective hole and including a pre-stressing system coupled thereto. The pre-stressing system may have a post-tensioning strand enclosed in a protective cover, with the protective cover having grout therein to surround and enclose the post-tensioning strand; an anchorage system positioned at each end of the post-tensioning strand and coupled to a respective end of the post-tensioning strand; and a compressive flange brace having an aperture to allow the post-tensioning strand to pass there through, the compressive flange brace preventing unwanted bending of the modular soldier pile during a pre-stressing operation.

According to yet another embodiment, a method to make a soldier pile wall for an excavation site may be summarized as including drilling a row of holes along an edge of the excavation site to form a corresponding drilled shaft; coupling a pre-stressing system to at least some of a plurality of soldier piles; placing each of the plurality of soldier piles within a respective drilled shaft; pouring cementitious material to fill the drilled shaft; excavating the excavation site; and inserting lagging laterally and between adjacent soldier piles.

DETAILED DESCRIPTION

The following detailed description is directed toward systems and methods for use in connection with earth retention walls of deep excavations, which is intended to provide an individual of ordinary skill in the art with enough information to enable that individual to make and use embodiments of the present disclosure. Such an individual, however, having read this entire detailed description and reviewed the figures, will appreciate that modifications can be made to the illustrated and described embodiments, and/or elements removed therefrom, without deviating from the spirit and scope of the disclosed subject matter. It is intended that all such modifications and deviations fall within the spirit and scope of the disclosed subject matter, to the extent they are within the scope of the associated claims.

Unless the context requires otherwise, throughout the specification and claims which follow, the word "comprise" and variations thereof, such as, "comprises" and "comprising" are to be construed in an open, inclusive sense, that is, as "including, but not limited to."

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

As used in this specification and the appended claims, the singular forms "a," "an," and "the" include plural referents unless the content clearly dictates otherwise. It should also be noted that the term "or" is generally employed in its sense including "and/or" unless the content clearly dictates otherwise.

Figure 1:
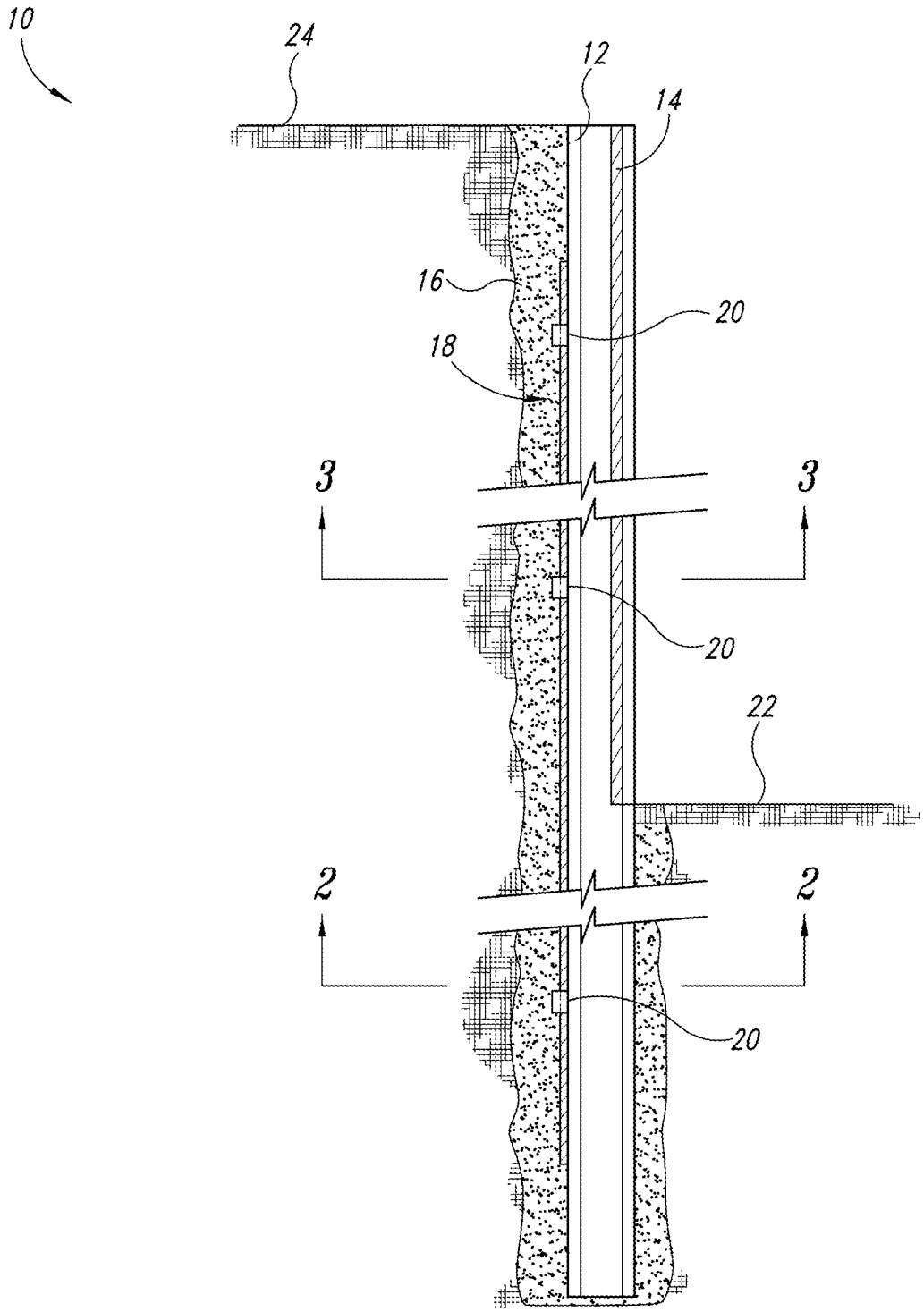
FIG. 1 is a side elevational view of a soldier pile wall with certain components removed for clarity, according to one embodiment.
Figure 2:
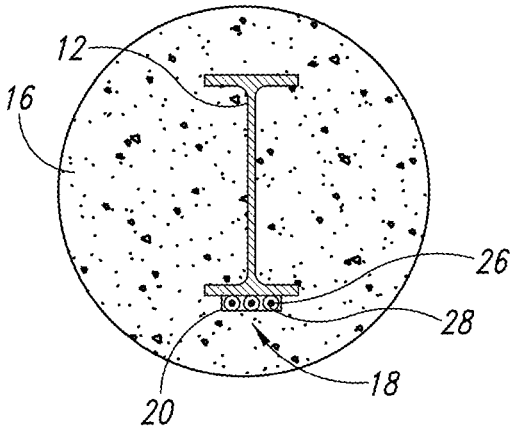
FIG. 2 is a sectional view of the soldier pile wall of FIG. 1, taken along line 2-2.
Figure 3:
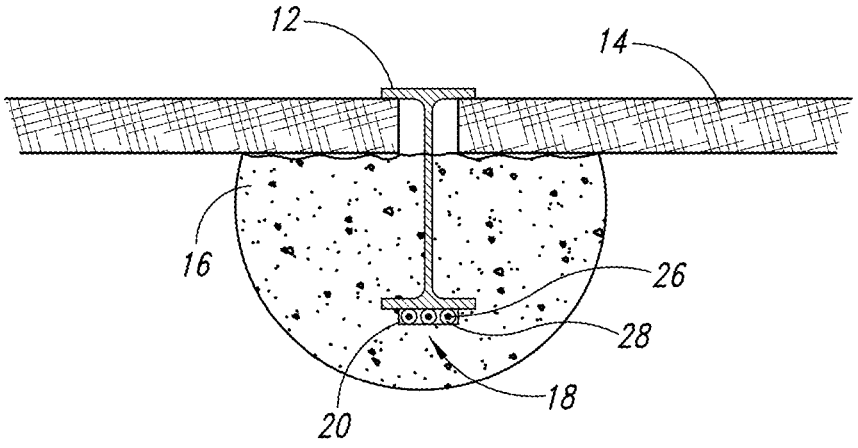
FIG. 3 is a sectional view of the soldier pile wall of FIG. 1, taken along line 3-3.

FIGS. 1-3 illustrate an example embodiment of a soldier pile wall 10 for shoring of deep excavations. The soldier pile wall 10 includes a drilled shaft 16 formed by a bored excavation of the earth. The drilled shaft 16 may be cylindrical with a diameter of between two to four feet and may have an appropriate length depending on the depth of the excavation, including extending a certain depth, such as between five and ten feet, beyond a bottom of the excavation 22 and extending up to a level of a finished grade 24 of the soldier pile wall 10. The soldier pile wall 10 may include a plurality of drilled shafts 16 that are positioned to be spatially spaced apart from each other along an edge of the excavation site. In some embodiments, each drilled shaft 16 may be spaced apart from an adjacent drilled shaft 16 by a spacing of between five and ten feet. In some embodiments, the spacing may be even closer, such as where secant piles or tangent piles are being constructed, for example.

A soldier pile 12 is placed within the drilled shaft 16. The soldier pile 12 substantially extends to both ends, lower and upper, of the drilled shaft 16. In the example embodiment, the soldier pile 12 has an I-shaped cross-section and at a backside flange includes a pre-stressing system 18 coupled thereto. In some embodiments, however, the pre-stressing system 18 may be set inside the flanges of the soldier pile 12, such as by coupling the pre-stressing system 18 to a web of the soldier pile 12, or other suitable location of the soldier pile 12. While the example embodiment has an I-shaped cross-section, in alternate embodiments, the soldier pile 12 may have an H-shaped cross-section, a T-shaped cross-section, or other cross-sections that provide suitable strength properties. Moreover, the soldier pile 12 may be made from structural steel, concrete, or other materials having suitable strength properties. The pre-stressing system 18 is coupled to the soldier pile 12 and includes three spatially spaced apart post-tensioning strands 26 that are each encapsulated within a protective cover 28. The post-tensioning strands 26 may be made from steel, or other high strength material.

Although the illustrated embodiment uses circular-shaped post-tensioning strands 26, in alternative embodiments, the pre-stressing system 18 may use bars or wires in lieu of the post-tensioning strands 26. The post-tensioning strands 26 are enclosed by the protective cover 28, which includes grout that surrounds the post-tensioning strands 26. Encapsulating the post-tensioning strands 26 with grout in this manner advantageously improves safety of the soldier pile wall 10 in instances where the post-tensioning strand 26 may snap or break apart by lowering any impact energy that may be imparted, by fully enclosing the post-tensioning strand 26 within the protective cover 28. Likewise, the corrosion properties of the post-tensioning strands 26 may also be improved by encapsulating them with grout.

The length and positioning of the pre-stressing system 18 on the soldier pile 12 is advantageously selected to impart compressive stresses where the soldier pile 12 is expected to experience the most relevant tensile forces. In the example embodiment illustrated in FIGS. 1-3, the pre-stressing system 18 is positioned at a range of three to six feet from the lower and upper ends of the soldier pile 12. More particularly, the pre-stressing system 18 extends along a center of the soldier pile 12 and includes compression flange braces 20 that are advantageously spaced apart to assist in distributing load through the soldier pile 12 during the pre-stressing operation, which is discussed in more detail elsewhere, and also to prevent any unwanted bending or bowing of the soldier pile 12 after the pre-stressing operation. Such unwanted bending or bowing of the soldier pile 12 may be in the minor or weak axis of the soldier pile 12, for example.

By way of example, in the embodiment illustrated in FIGS. 1-3, each compression flange brace 20 is positioned at a one-third distance along the length of the pre-stressing system 18, which advantageously assists in distribution of the load and also prevents unwanted bending or bowing of the soldier pile 12. However, in alternate embodiments, the spacing and the number of compression flange braces 20 may vary, depending on the particular application. The compression flange braces 20 are coupled to the soldier pile 12 using various techniques, such as by welding, fastening, or the like, and include apertures through which the post-tensioning strands 26 pass therethrough.

With continued reference to FIGS. 1-3, after the soldier pile 12 having a pre-stressing system 18 is placed within the drilled shaft 16, a hole encompassing the drilled shaft 16 is thereafter filled with plain or reinforced cementitious material, such as lean or structural mix of concrete, for example. To provide lateral support during excavation and post-excavation, lagging 14 is inserted between each adjacent soldier pile 12 commencing above the bottom of the excavation 22 and extending laterally from behind the front side flange of the soldier pile 12. The lagging 14 may be made from timber, steel, or other material having suitable strength properties. As illustrated in FIG. 1, the lagging 14 may extend from between a bottom of the excavation 22 level to the level of the finished grade 24 of the soldier pile wall 10. Moreover, in some embodiments, the lagging may comprise concrete, such as a secant pile, for example, and may extend between adjacent soldier piles 12.

Figure 4:
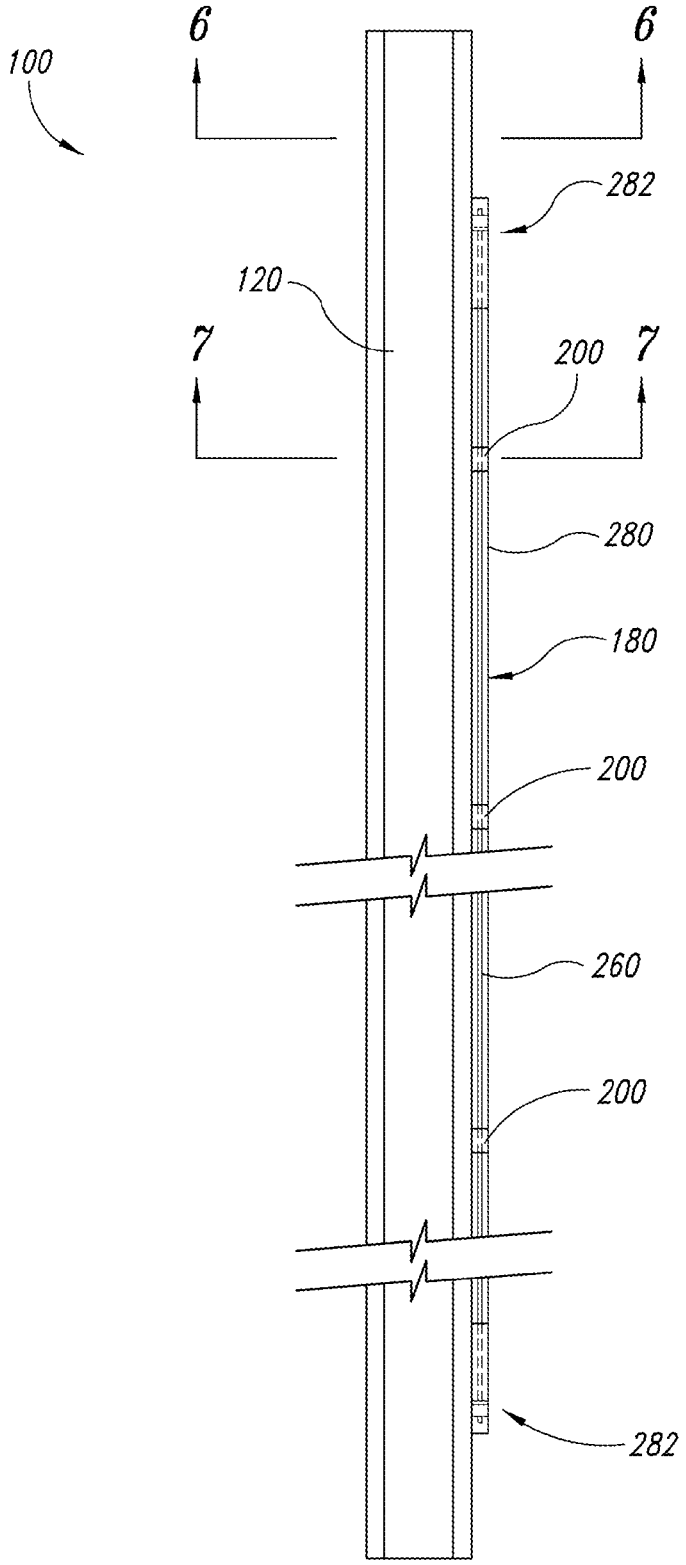
FIG. 4 is a side elevational view of a soldier pile wall with certain components removed for clarity, according to another embodiment.
Figure 5:
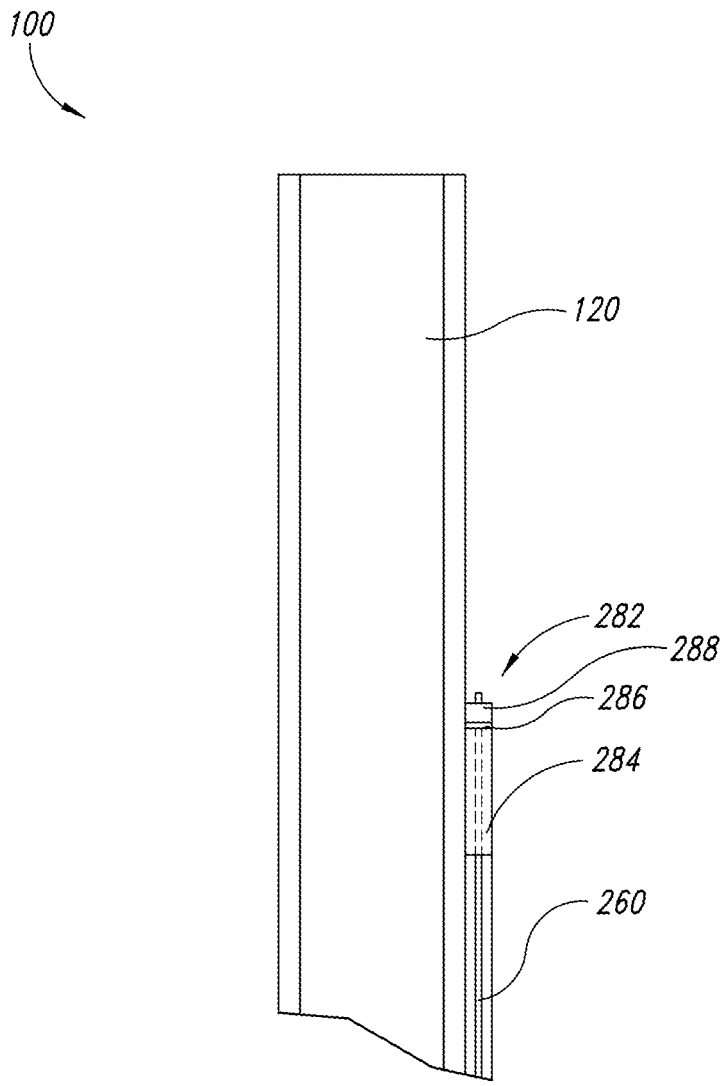
FIG. 5 is a detail side elevational view of the soldier pile wall of FIG. 4.
Figure 6:
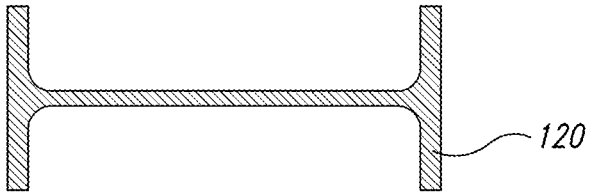
FIG. 6 is a sectional view of the soldier pile wall of FIG. 4, taken along line 6-6.
Figure 7:
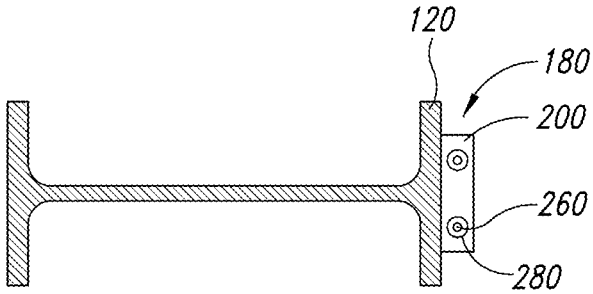
FIG. 7 is a sectional view of the soldier pile wall of FIG. 4, taken along line 7-7.

FIGS. 4-7 illustrate another embodiment of a soldier pile wall 100, with certain components removed for clarity. More particularly, the soldier pile wall 100 illustrates an anchorage system 282 used in connection with pre-stressing a soldier pile 120. As best illustrated in FIGS. 4 and 5, the anchorage system 282 is coupled the soldier pile 120 proximal to upper and lower ends of the post-tensioning strands 260. The anchorage system 282 includes side plates 284 coupled to a backside flange of the soldier pile 120, thus creating a gap therebetween to provide a passageway for the post-tensioning strands 260 to pass therethrough. In some embodiments, each post-tensioning strand 260 may pass through the passageway, while in other embodiments, any number of post-tensioning strands 260 may pass through the passageway. The side plates 284 may be coupled to the soldier pile 120 by welding, fastening, or the like. At terminating ends of the side plates 284, an anchor plate 286 is coupled thereto. The anchor plate 286 is oriented to be substantially perpendicular to the side plates 284. The anchor plate 286 includes apertures to allow the respective post-tensioning strand 260 to pass therethrough and into a respective anchor head 288. The anchor head 288 may include therein wedges, threaded nuts, or the like to hold the post-tensioning strands 260 during the pre-stressing operation, which is discussed in greater detail elsewhere.

With continued reference to FIGS. 4-7, the soldier pile wall 100 provides a variation to the soldier pile wall 10 illustrated in FIGS. 1-3, but is not limiting in any respect. The soldier pile wall 100 includes a pre-stressing system 180 that includes two spaced apart post-tensioning strands 260. The post-tensioning strands 260 are enclosed within a protective cover 280, which includes grout surrounding the post-tensioning strand 260. A plurality of compression flange braces 200 are coupled to the backside flange of the soldier pile 120 and include apertures to allow a respective post-tensioning strand 260 to pass therethrough.

Figure 8:
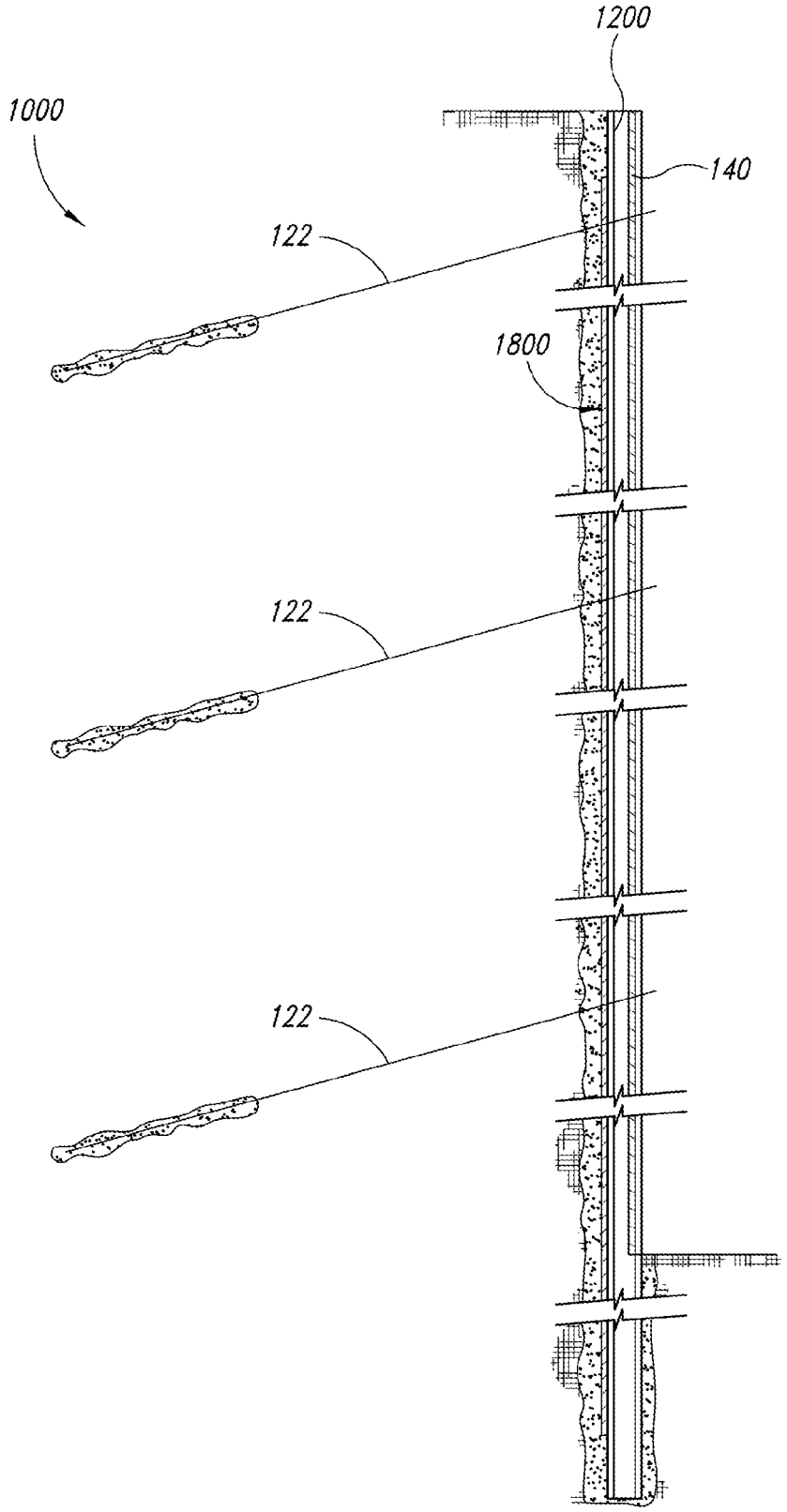
FIG. 8 is a side elevational view of a soldier pile wall with certain components removed for clarity, according to another embodiment.

FIG. 8 illustrates another embodiment of a soldier pile wall 1000. This soldier pile wall 1000 illustrates a variation, where tie-back anchors 122 are installed through a soldier pile 1200, pre-stressing system 1800, and lagging 140. As illustrated in FIG. 8, only three tie-back anchors 122 are used in the soldier pile wall 1000, where design loads may have required twelve tie-back anchors 122, due to advantageously providing the pre-stressing system 1800 in the manner described herein.

A method to install embodiments of the soldier pile walls described herein, according to one embodiment, may include drilling a row of holes along an edge of an excavation site to form a respective drilled shaft. The holes may be caisson holes, tangent holes, secant holes, or the like. In some embodiments, a casing may also be placed within the drilled hole. The casing may be driven, vibrated, jetted, or oscillated into position. Thereafter, a pre-stressed soldier pile is placed within the respective drilled shaft. Pre-stressing or post stressing the soldier pile may include fixedly holding in position one end of the pre-stressing system, such as the anchor heads, and releasably coupling the other end or the other anchor heads to a hydraulic jack or the like. The hydraulic jack may apply a pre-set tension to the post-tensioning strands. In some embodiments, the pre-set tension may be applied sequentially until the desired tension is obtained in the soldier pile.

Pre-stressing the soldier piles in this manner induces opposite stresses in the soldier piles, which can counteract the working stresses developed in the soldier piles during use. Moreover, the direction and magnitude of the induced stresses is controlled by coupling compression flange braces, as described in more detail elsewhere. Further, pre-stressing the soldier piles may allow for using lighter and more slender soldier piles, improve the fatigue life, enhance the elastic range of the soldier pile material, and improve load-carrying capability of the soldier pile walls, thus eliminating or reducing the need for tie-backs, struts, bracing, or other forms of reinforcement structure.

The pre-stressing operation may be accomplished off-site, or in some embodiments, the pre-stressing of the soldier pile may be accomplished after the soldier pile is placed within the drilled shaft. Prior to, or thereafter, cementitious material, such as lean or structural mix of concrete may be poured to fill and surround the soldier pile prior to commencement of the excavation. As the drilled shafts become exposed during excavation, the sides of the drilled shafts may be scraped away to expose the soldier piles, and lagging may be installed between the adjacent soldier piles until the bottom of the excavation is reached.

In some embodiments, a reduced number of tie-backs may also be installed. Tie-back anchors may be drilled through, or between, the drilled shafts, and into the earth behind the soldier pile wall. The tie-back anchor holes may be pre-drilled through the soldier piles or may be drilled on site. A tie-back anchor may thereafter be installed through the tie-back anchor holes, or a waler may be used for anchors set between soldier piles.

Moreover, the various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A soldier pile wall for shoring an excavation site, the soldier pile wall comprising:

a plurality of drilled shafts drilled along an edge of the excavation site;

a plurality of soldier piles, each of the plurality of soldier piles being positioned within a respective drilled shaft and having an I-shaped cross-section or an H-shaped cross-section; and a pre-stressing system coupled to at least some of the plurality of soldier piles, the pre-stressing system configured to induce stresses to counteract working stresses of the soldier pile wall, wherein each soldier pile includes a flange having an exterior surface, the pre-stressing system coupled to the exterior surface of the flange.

2. The soldier pile wall of claim 1 wherein the pre-stressing system includes a post-tensioning strand.

3. The soldier pile wall of claim 2 wherein the pre-stressing system further comprises:

a protective cover having grout therein, the grout surrounding the post-tensioning strand.

4. The soldier pile wall of claim 2, further comprising:

a compressive flange coupled to the soldier pile, the compressive flange including an aperture to allow a corresponding post-tensioning strand to pass therethrough.

5. The soldier pile wall of claim 1 wherein each of the plurality of drilled shafts includes cementitious material surrounding the soldier pile.

6. The soldier pile wall of claim 1, further comprising:

a plurality of laggings extending laterally between the plurality of soldier piles, each lagging being coupleable to a front side flange of each of adjacent soldier piles.

7. The soldier pile wall of claim 1, further comprising:

a plurality of compressive flanges coupled to the exterior surface of the flange of the soldier pile.

8. The soldier pile wall of claim 7 wherein the soldier pile includes a first end and a second opposing end and, wherein, the plurality of compressive flanges include at least a first compressive flange positioned proximal to the first end of the soldier pile, at least a second compressive flange positioned proximal to the second end of the soldier pile, and at least a third compressive flange positioned between the first compressive flange and the second compressive flange.

9. A soldier pile wall for shoring an excavation site, the soldier pile wall comprising:

a plurality of drilled shafts drilled along an edge of the excavation site;

a plurality of soldier piles, each of the plurality of soldier piles being positioned within a respective drilled shaft and having an I-shaped cross-section or an H-shaped cross-section;

a pre-stressing system coupled to at least some of the plurality of soldier piles, the pre-stressing system configured to induce stresses to counteract working stresses of the soldier pile wall; and a plurality of laggings extending laterally between the plurality of soldier piles, the plurality of laggings comprising concrete of a secant pile.

10. A system for shoring an excavation site having a plurality of adjacent holes drilled along an edge of the excavation site where a soldier pile wall is to be erected, the system comprising:

a plurality of modular soldier piles, each of the plurality of modular soldier piles to be positioned within a respective hole and including a pre-stressing system, each modular soldier pile having an I-shaped cross-section or an H-shaped cross-section and a flange having an exterior surface, the pre-stressing system coupled to the exterior surface of the flange of the modular soldier pile, the pre-stressing system having:

a post-tensioning strand enclosed in a protective cover, the protective cover having grout therein to surround and enclose the post-tensioning strand;

an anchorage system positioned at each end of the post-tensioning strand and coupled to a respective end of the post-tensioning strand; and a compressive flange brace having an aperture to allow the post-tensioning strand to pass therethrough, the compressive flange brace preventing bending of the modular soldier pile during a pre-stressing operation.

11. A method to make a soldier pile wall for an excavation site, the method comprising:

drilling a row of holes along an edge of the excavation site to form a corresponding drilled shaft;

coupling a pre-stressing system to at least some of a plurality of soldier piles, each of the plurality of soldier piles having an I-shaped cross-section or an H-shaped cross-section, wherein coupling the pre-stressing system to at least some of the plurality of soldier piles includes coupling the pre-stressing system to an exterior surface of a flange of the soldier pile;

placing each of the plurality of soldier piles within a respective drilled shaft;

pouring cementitious material to fill the drilled shaft;

excavating the excavation site; and inserting lagging laterally and between adjacent soldier piles.

12. The method of claim 11 wherein the pre-stressing system includes a post-tensioning strand enclosed and surrounded by a protective cover having grout.

13. The method of claim 11, further comprising:

coupling a compressive flange brace to the soldier pile having the pre-stressing system coupled thereto.

14. The method of claim 11, further comprising:

tensioning the soldier pile having the pre-stressing system coupled thereto, wherein the tensioning step comprises:

fixedly holding a first end of the pre-stressing system;

releasably coupling a second end of the pre-stressing system to a hydraulic jack; and applying a pre-set tension to the pre-stressing system.

15. The method of claim 14 wherein the soldier pile is tensioned after being placed within the drilled shaft.

16. The method of claim 11 wherein the coupling step comprises:

coupling an anchorage system at each end of the pre-stressing system; and coupling a plurality of post-tensioning strands to the anchorage system.

* * * * *